United States Patent [19]

Hill et al.

[11] 4,279,765

[45] Jul. 21, 1981

[54] SOAP COMPOSITION CONTAINING AN AMINO-SUBSTITUTED POLYSILOXANE

[75] Inventors: Michael P. L. Hill, St. Lythans, Nr. Wenvoe, Wales; Anthony N. Tizard, Weybridge, England

[73] Assignee: Dow Corning Limited, Barry, Wales

[21] Appl. No.: 184,853

[22] Filed: Sep. 8, 1980

[30] Foreign Application Priority Data

Sep. 15, 1979 [GB] United Kingdom ..... 32069/79

[51] Int. Cl.[3] ..... C11D 9/36

[52] U.S. Cl. ..... 252/117; 252/544; 252/DIG. 5

[58] Field of Search ..... 252/117, 132, 544, 174.15, 252/DIG. 5, 134, 174, DIG. 16

[56] References Cited

U.S. PATENT DOCUMENTS

| | | | |
|---|---|---|---|
| 2,762,823 | 9/1956 | Speier | 252/544 X |
| 2,826,551 | 3/1958 | Geen | 252/174.15 |

*Primary Examiner*—Harris A. Pitlick

*Attorney, Agent, or Firm*—Robert F. Fleming, Jr.

[57] ABSTRACT

A soap composition which contains from 0.01 to 6% by weight of a polydiorganosiloxane having a molecular weight of at least 2000 and in which at least one of the silicon-bonded substituents is a monovalent group composed of carbon, hydrogen, nitrogen and, optionally, oxygen, the monovalent group having therein at least one amino group. The polydiorganosiloxane imparts a durable soft feel to skin contacted with the soap.

3 Claims, No Drawings

SOAP COMPOSITION CONTAINING AN AMINO-SUBSTITUTED POLYSILOXANE

This invention relates to a soap composition containing an organopolysiloxane.

Soaps have for many years been employed as cleansing agents for the skin and other substrates. In recent years it has become the practice to improve the properties of the soap by the incorporation of additives. For example, coconut oil or palm kernal oil may be added to improve lather formation. So-called superfatting agents such as lanolin, fatty acid derivatives and lecithin may also be added to mitigate the degreasing effect of the soap on human skin. Another property which is often desired in a soap is an ability to produce a soft creamy lather having the appearance and effect of a skin cream. Some of the known superfatting agents have the ability to produce a soft creamy lather but the softening effect on human skin has been of limited duration.

It has been proposed to incorporate polymethylsiloxanes into soaps to prevent the soap becoming too soft in water and to prevent the soap tablets from cracking when dry. It has also been disclosed in British Pat. No. 998,076 that silicone liquids such as polydimethylsiloxanes, poly(phenylmethyl)siloxanes and polysiloxane-polyoxyalkylene copolymers can be incorporated into shaving creams to lubricate the skin. Any softening effect produced by such polysiloxanes however dissipates in a relatively short time and there has existed a need for a means of obtaining such an effect which is more resistant to washing and abrasion.

According to this invention there is provided a soap composition which contains from 0.01 to 6% by weight, based on the total weight of the composition, of a polydiorganosiloxane having a molecular weight of at least 2000 and having in the molecule at least one silicon-bonded organic substituent which is a monovalent group composed of carbon, hydrogen, nitrogen, and, optionally, oxygen, said monovalent group having therein at least one amino group and being linked to the silicon atom through a silicon to carbon bond, at least 50 percent of the total number of substituents in said polydiorganosiloxane being methyl groups, any remaining substituents being selected from monovalent hydrocarbon groups having at least two carbon atoms, alkoxy groups, alkoxy-alkoxy groups or hydroxy groups.

The polydiorganosiloxanes employed in the soap compositions of this invention are linear or substantially linear polymers having a molecular weight of at least 2000. At least one of the silicon-bonded substituents in the molecule is a monovalent group composed of carbon, hydrogen, nitrogen and, optionally, oxygen and containing at least one amino group. Preferably the amino group-containing substituents have less than 21 carbon atoms and are joined to the silicon atom through a bridge of at least 3 carbon atoms. Any oxygen present may exist in the form of ether and/or carbonyl groups. Examples of the operative amino-containing substituents are:

$-CH_2CH_2CH_2NH_2$, $-(CH_2)_3NH\ CH_2CH_2NH_2$, $-(CH_2)_3NH\ CH_2CH_2CH_2NH_2$, $-(CH_2)_3NH\ (CH_2CH_2NH)_xH$ in which x is for example 2, 3 or 4.

$$-(CH_2)_3NH\ \underset{}{\overset{CH_2CH_2NH_2}{\overset{|}{CH_2CH_2CH}}}(CH_2)_3NH_2 \text{ and}$$

$-(CH_2)_3NH\ (CH_2)_2NH\ CH_2CH_2COO\ CH_3$, the groups $-(CH_2)_3\ NH(CH_2)_2NH_2$ and $-CH_2CH(CH_3)CH_2NH(CH_2)_2NH_2$ being preferred.

At least 50% of the silicon-bonded organic substituents present in the polydiorganosiloxane should be methyl groups. Any substituents present in addition to the said methyl groups and the specified amino-containing substituents are monovalent hydrocarbon groups, for example ethyl, propyl, 2,4,4-trimethylpentyl, octadecyl, phenyl and vinyl, alkoxy and alkoxyalkoxy groups, for example methoxy, ethoxy, propoxy and methoxyethoxy, and hydroxyl groups. Preferably the silicon-bonded substituents present in the polydiorganosiloxane in addition to the amino-containing groups are methyl groups, with or without small proportions of groups selected from alkoxy, alkoxyalkoxy and hydroxyl groups. Preferably also the amino group-containing substituents are present in a proportion not exceeding one substituent per ten silicon atoms.

Examples of the polydiorganosiloxanes which can be employed in the compositions of this invention are $$Y\!\!+\!\!O\ Si\ Me_2]_a\ [O\ Si(X)Me]_b\ OY$$

and $$Me\ \overset{OMe}{\overset{|}{\underset{\underset{X}{|}}{Si}}}\ [O\ Si\ Me_2]_nOZ$$

in which Me represents the methyl group, X represents the amino group-containing substituent e.g. $-(CH_2)_3HN\ CH_2CH_2NH_2$, Y represents a hydrogen atom or trihydrocarbylsilyl group e.g. $Me_3Si$- Ph $Me_2$-Si- or Vi $Me_2Si$-, in which Ph and Vi represent phenyl and vinyl respectively, Z represents a hydrogen atom or the group Me(OMe)(X)Si-, and a, b and n are integers e.g. 96, 4 and 500 respectively.

Methods of preparing the operative polydiorganosiloxanes are well-known in the art and include the reaction of a siloxane containing silicon-bonded hydroxyl groups with a silane such as $(CH_3O)_3Si(CH_2)_3NH(CH_2)_2NH_2$ or $(CH_3O)_2CH_3Si(CH_2)_3NH(CH_2)_2NH_2$, or the polymerisation of a cyclic siloxane in the presence of such a silane or its hydrolysis product.

The compositions of this invention can be based on any soap component. Soaps are predominantly the alkali metal salts (most usually the Na and K salts) of the higher fatty acids, particularly those having from about 12 to about 18 carbon atoms. Such fatty acids can be derived from a variety of fats and oils e.g. tallow, coconut oil, palm oil, palm kernel oil and lard. The soap component may therefore comprise, for example, sodium palmitate, sodium stearate, sodium oleate, potassium laurate, potassium stearate or potassium myristate. Depending on the type of soap composition desired it may contain only one soap or it may be based on two or more soaps, for example mixtures of sodium palmitate, sodium stearate and sodium oleate. In addition to the soap component and the polydiorganosiloxane component the soap compositions of this invention may, if desired, contain additives to improve performance and aesthetic appeal or to provide other special effects therein. Examples of such additives are perfumes, super-fatting agents, thickening agents, dyes and lubricants. The preferred soap compositions according to this invention are those which take the form of blocks (or tablets), as is the case with most toilet soaps, and soaps having a liquid or creamy consistency, for example shaving soaps and soaps of the type supplied from an automatic liquid dispenser, the latter usually comprising the potassium, ammonium or triethanolamine soaps of coconut, olive or other low titre oils.

The soap compositions of this invention can be prepared by any of the techniques conventional in soap manufacture. Most conveniently the polydiorganosiloxane component is incorporated with any other additives during the conventional finishing operations such as the mixing and milling steps. The polydiorganosiloxane may be incorporated into the soap composition in any convenient form, for example as such, as an aqueous emulsion or in admixture with other components of the composition.

The proportion of the polydiorganosiloxane component incorporated into the soap composition may vary from 0.01 to 6% by weight based on the total weight of the composition. Preferably, however, the polydiorganosiloxane is present in an amount of from 0.05 to 2 percent by weight.

The invention of illustrated by the following examples:

EXAMPLE 1

Soap noodles, free of additives such as perfumes and super-fatting agents, were mixed in a blender with 1% by weight, based on the weight of the soap, of an aminofunctional siloxane copolymer prepared by polymerising a cyclic dimethylsiloxane and reacting the polymerised product with about 2% by weight (based on the cyclic siloxane) of $(CH_3O)_3$ Si $(CH_2)_3NH$ $CH_2CH_2NH_2$, the polymerisation and reaction being carried out in aqueous emulsion. The aminofunctional siloxane had a molecular weight of approximately 125,000 and was incorporated in the form of a 35% by weight aqueous emulsion.

The resulting product was pressed into a block and used as a toilet soap for the hands. No significant reduction in the lather obtainable resulted from the presence of the siloxane and after washing the hands several times the skin acquired a soft, silky feel.

Similar results were obtained when the aminofunctional siloxane was added in a proportion of 3% by weight, based on the weight of the soap.

EXAMPLE 2

Soap noodles, as described in Example 1, were mixed in a blender with 2% by weight, based on the weight of soap, of a polysiloxane having the average formula $$HO\left[Me_2SiO\right]_n \overset{\overset{OMe}{|}}{Si}\,Me(X)$$

in which X represents $-(CH_2)_3NH\ CH_2CH_2NH_2$ and n has a value of approximately 500.

The resulting soap composition was pressed into a block and employed as a toilet soap for the hands. The soap lathered freely and after several washes with the soap a durable soft silky feel was imparted to the hands.

That which is claimed is:

1. A soap composition which contains from 0.01 to 6% by weight, based on the total weight of the composition, of a polydiorganosiloxane having a molecular weight of at least 2000 and having in the molecule at least one silicon-bonded organic substituent which is a monovalent group composed of carbon, hydrogen, nitrogen and, optionally, oxygen, said monovalent group having therein at least one amino group and being linked to the silicon atom through a silicon to carbon bond, at least 50 percent of the total number of substituents in said polydiorganosiloxane being methyl groups, any remaining substituents being selected from monovalent hydrocarbon groups having at least two carbon atoms, alkoxy groups, alkoxyalkoxy groups or hydroxy groups.

2. A soap composition as claimed in claim 1 wherein the amino group containing the substituents in the polydiorganosiloxane are selected from $-(CH_2)_3NH$ $(CH_2)_2NH_2$ and $-CH_2CH(CH_3)CH_2NH(CH_2)_2NH_2$ groups.

3. A soap composition as claimed in claim 1 wherein the amino group-containing substituents are present in the polydiorganosiloxane in a proportion not exceeding one substituent per ten silicon atoms.

* * * * *

UNITED STATES PATENT AND TRADEMARK OFFICE

CERTIFICATE OF CORRECTION

PATENT NO. : 4,279,765

DATED : July 21, 1981

INVENTOR(S) : Michael P. L. Hill; Anthony N. Tizard

It is certified that error appears in the above-identified patent and that said Letters Patent are hereby corrected as shown below:

In Column 1, line 11; the line reading "example, coconut oil or palm kernal oil may be added to" should read "example, coconut oil or palm kernel oil may be added to"

In Column 2, line 37; the line reading "$-(CH_2)_3HN\ CH_2CH_2NH_2$, Y represents a hydrogen" should read "$-(CH_2)_3NH\ CH_2CH_2NH_2$, Y represents a hydrogen"

UNITED STATES PATENT AND TRADEMARK OFFICE

CERTIFICATE OF CORRECTION

PATENT NO. : 4,279,765

DATED : July 21, 1981

INVENTOR(S) : Michael P. L. Hill; Anthony N. Tizard

It is certified that error appears in the above-identified patent and that said Letters Patent are hereby corrected as shown below:

In Column 3, line 28; the line reading "The invention of illustrated by the following exam-" should read "The invention is illustrated by the following exam-"

Signed and Sealed this

*Twenty-sixth* Day of *January 1982*

[SEAL]

*Attest:*

GERALD J. MOSSINGHOFF

*Attesting Officer*

*Commissioner of Patents and Trademarks*